US005199413A

United States Patent [19]

Chen

[11] Patent Number: 5,199,413

[45] Date of Patent: Apr. 6, 1993

[54] MOBILE SPIRIT STOVE

[76] Inventor: Ming-Jing Chen, No. 3 Alley 55, Lane 352, Chye Dong Load, Ah Yi Li, Changhua, Taiwan

[21] Appl. No.: 909,737

[22] Filed: Jul. 7, 1992

[51] Int. Cl.[5] ..... F24C 5/00

[52] U.S. Cl. ..... 126/43; 431/146

[58] Field of Search ..... 126/43, 44, 50, 95, 126/1 R; 431/320, 310, 313, 152, 144, 149, 146

[56] References Cited

U.S. PATENT DOCUMENTS 3,606,609 9/1971 Lipper et al. ..... 126/43

FOREIGN PATENT DOCUMENTS 3574 1/1980 Japan ..... 431/320

*Primary Examiner*—James C. Yeung

*Attorney, Agent, or Firm*—Morton J. Rosenberg; David I. Klein

[57] ABSTRACT

A mobile spirit stove comprising an alcohol fuel container to hold glass fibers and alcohol fuel, a perforated cover which is shaped into straight parallel regular and equally curved ridges and hollows and having holes over the ridges through which alcohol fuel gas flows out of the alcohol fuel container for making fires, and holes over the hollows through which outside air is induced into the alcohol fuel container for circulation, and a fire extinguishing cover for extinguishing fires over the perforated plate after each use of the stove.

1 Claim, 3 Drawing Sheets

MOBILE SPIRIT STOVE

BACKGROUND OF THE INVENTION

The present invention relates to mobile stoves and relates more particularly to a mobile spirit stove which can be used indoors as well as outdoors for cooking meat by burning alcohol fuel.

Various spirit stoves are known and commonly used outdoors for cooking meat and etc. The conventional spirit stoves, as shown in FIG. 5, is generally comprised of a plurality of small, circular alcohol fuel containers contained with alcohol fuel for making a fire. Because of less convection current, less intensity of fire is produced. Furthermore, the fire made over the alcohol fuel container in a spirit stove can not heat a cooking basin evenly for cooking meat and etc. efficiently.

SUMMARY OF THE INVENTION

The present invention eliminates the aforesaid disadvantages. According to one aspect of the present invention, a mobile spirit stove is generally comprised of an alcohol fuel container to hold glass fibers and alcohol fuel, and a perforated cover plate covered on the alcohol fuel container over which fires are made, wherein the perforated cover plate is shaped into straight parallel regular and equally curved ridges and hollows and having holes over the ridges through which alcohol fuel gas flows out of the alcohol fuel container for making fires, and holes over the hollows through which outside air is induced into the alcohol fuel container for circulation. According to another aspect of the present invention, a fire extinguishing cover is provided for extinguishing fires over the perforated plate after each use of the stove. The fire extinguishing cover is also shaped into straight parallel regular and equally curved ridges and hollows matching the ridges and hollows on the perforated plate tightly.

DETAILED DESCRIPTION OF THE PREFERRED EMBODIMENT

Figure 1:
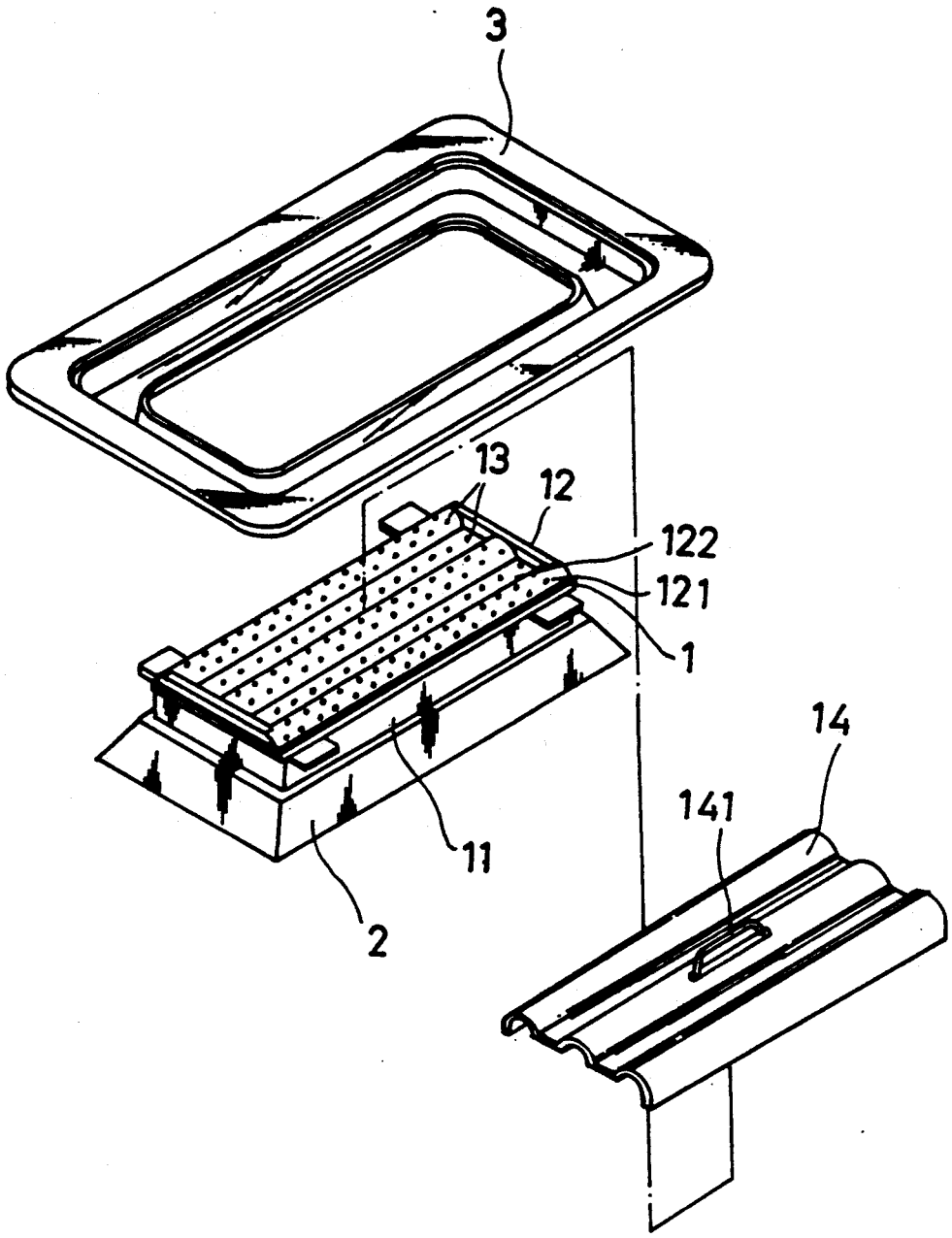
FIG. 1 is a dismantled view of the preferred embodiment of the mobile spirit stove of the present invention.
Figure 2:
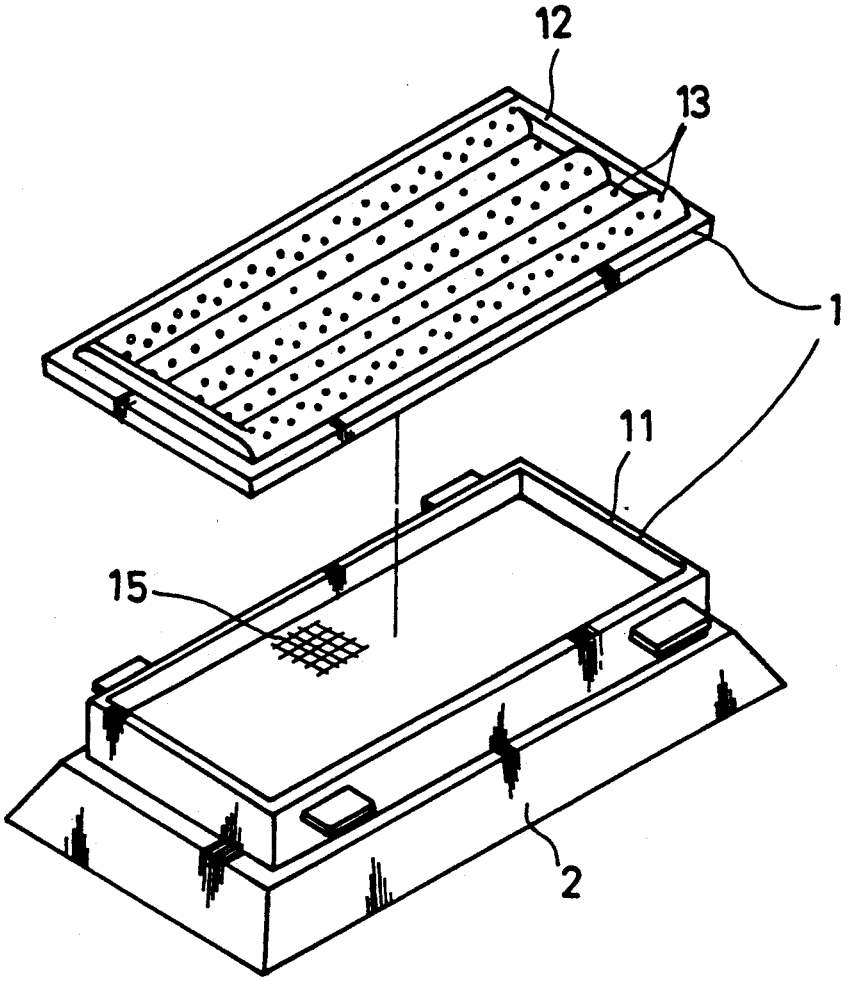
FIG. 2 is a dismantled view of the alcohol fuel container and the perforated plate thereof.
Figure 5:
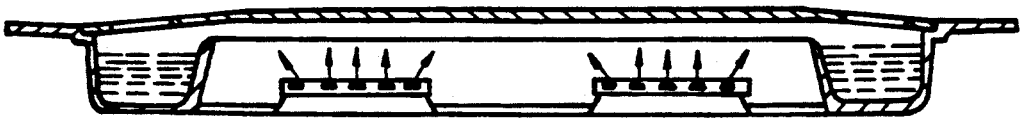
FIG. 5 illustrates the use of a prior art spirit stove.
Figure 3:
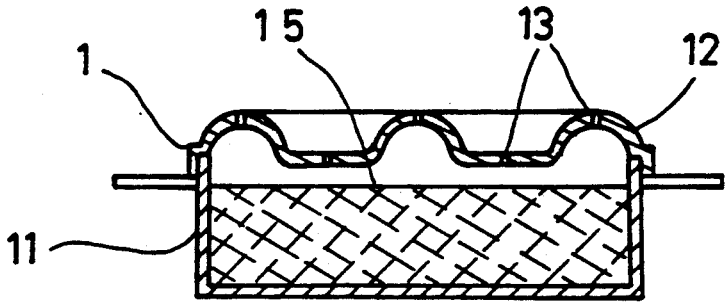
FIG. 3 is a sectional assembly view thereof.
Figure 4:
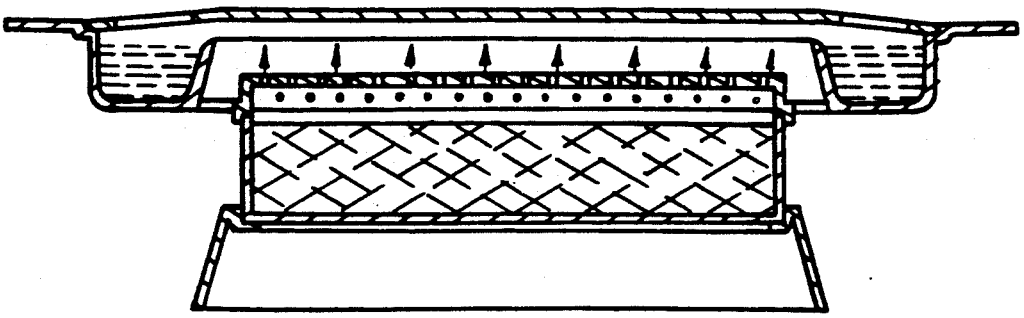
FIG. 4 illustrates the use of the present invention in burning alcohol fuel for cooking.

Referring to FIGS. 1, 2 and 3, the spirit stove 1 is comprised of a fire extinguishing cover 14, a perforated plate 12, an alcohol fuel container 11, and glass fibers 15. The alcohol fuel container 11 is supported on a base 2 to hold glass fibers 15 and alcohol fuel. The fire extinguishing cover 14 has a handle 141 for the holding of the hand, and is used to extinguish the spirit stove after each use. The perforated plate 12 which is covered on the alcohol fuel container 11 is shaped into straight parallel regular and equally curved ridges 121 and hollows 122 having holes 13 over the ridges 121 and hollows 122. Therefore, alcohol fuel gas flows out of the alcohol fuel container through the holes 13 on the ridges 121 for making fires in heating a cooking basin 3, and outside air is induced into the alcohol fuel container 11 through the holes 13 on the hollows 122 for circulation. The formation of convection current greatly intensifies the intensity of open fire.

What is claimed is:

1. A mobile spirit stove comprising an alcohol fuel container supported on a base to hold glass fibers and alcohol fuel, a perforated plate mounted on said alcohol fuel container, said perforated plate having an undulating cross-section defining linearly directed parallel equally curved ridges and hollows having a first set of holes through said ridges wherein heated alcohol fuel gas flows from said alcohol fuel container for making fires, and a second set of holes through said hollows through which external aid is induced into said alcohol fuel container for circulation; and, a fire extinguishing cover, said fire extinguishing cover being contoured into straight parallel regular and equally curved ridges and hollows matingly engaging said ridges and hollows of said perforated plate for extinguishing fires after each use of the stove.

* * * * *